United States Patent [19]

Stevens et al.

[11] 4,003,675

[45] Jan. 18, 1977

[54] ACTUATING MECHANISM FOR GAS TURBINE ENGINE NOZZLES

[75] Inventors: Wallace Gene Stevens, Dunlap; Karl Wilfred Karstensen, Peoria, both of Ill.

[73] Assignee: Caterpillar Tractor Co., Peoria, Ill.

[22] Filed: Sept. 2, 1975

[21] Appl. No.: 609,764

[52] U.S. Cl. ..... 415/150; 415/160

[51] Int. Cl.[2] ..... F01D 17/12

[58] Field of Search ..... 415/147, 148, 149, 150, 415/151, 160, 43

[56] References Cited

UNITED STATES PATENTS

| | | | |
|---|---|---|---|
| 1,499,475 | 1/1924 | Prince | 415/160 |
| 2,037,395 | 4/1936 | Seelig | 415/160 |
| 3,013,771 | 12/1961 | Henny | 415/149 |
| 3,041,039 | 6/1962 | Ambroz | 415/43 |
| 3,318,574 | 5/1967 | Tyler | 415/148 |
| 3,352,537 | 11/1967 | Petrie | 415/160 |
| 3,574,479 | 4/1971 | Barnard | 415/147 |
| 3,632,224 | 1/1972 | Wright et al. | 415/149 |
| 3,904,309 | 9/1975 | Keetley | 415/160 |

*Primary Examiner*—Henry F. Raduazo
*Attorney, Agent, or Firm*—Phillips, Moore, Weissenberger, Lempio & Strabala

[57] ABSTRACT

A mechanism for varying the position of a plurality of nozzle vanes in a gas turbine engine. The mechanism includes a single double-acting hydraulic actuating jack disposed between two bell cranks for simultaneously applying force to a ring gear at two diametrically opposed connection points. The single actuating jack applies equal and opposite forces to the diametrically opposed connection points on the ring gear and reduces distortion producing stresses therein. The ring gear simultaneously engages a plurality of individual gear segments rotatable with each individual nozzle vane in the engine. Movement of the single actuator jack causes balanced rotation of the ring gear and simultaneous rotation of the nozzle vanes.

5 Claims, 5 Drawing Figures

1
8
6
5
III
III
9
4
3
2
II
3
4
8
9
6
7
5
II 6
5
4
7

ACTUATING MECHANISM FOR GAS TURBINE ENGINE NOZZLES

BACKGROUND OF THE INVENTION

The present invention relates to variable area nozzles of the type employed with either a turbine or compressor rotor and more particularly to a nozzle assembly including intermeshing gear segments for positively positioning nozzle vanes.

Variable area nozzles are utilized in gas turbine engines to improve efficiency over relatively wide ranges of operating rotor speeds. In such nozzles, it is necessary to accurately position each of the movable vanes and to maintain them in selected positions during the operation of the turbine rotor. Such accuracy is difficult to maintain, for example, due to excessive tolerances arising in a drive arrangement for positioning the vanes, to distortion caused by the flow of hot gases through the nozzles, and to distortion caused by imbalanced loading on the actuator parts.

In the prior art, one arrangement for controlling movable nozzle vanes employs a ring gear arranged about the nozzle vanes for simultaneous positioning thereof. Exemplary of such prior art systems are those disclosed in U.S. Pat. Nos. 3,252,686 to Chadwick; 3,383,090 to McLean; and 3,376,018 to Williamson. Each of these arrangements utilize single actuator jacks for rotating a ring member which causes the simultaneous actuation of a plurality of vanes through connecting means. Such systems, due to the single point force application from the actuator jack, cause an imbalance of loading on the ring member which can lead to distortion of the parts and inaccuracy in nozzle placement.

Other prior art devices utilize a plurality of separate actuator jacks connected to various points along a ring gear to position same. Again, an imbalance of forces on the ring gear is occasioned by any unequal or imprecise movement of the multiple jacks.

The present invention is directed to a simple and inexpensive nozzle actuator system which produces balanced forces on the operable components and which produces accurate and precise simultaneous positioning of a plurality of nozzle vanes.

SUMMARY AND OBJECTS OF THE INVENTION

The instant vane positioning system comprises a ring gear acted upon at two diametrically opposed peripheral points by dual bell crank linkages which in turn are acted upon by a single double-acting hydraulic motor. The motor is free to move between the two bell crank connections and may thus exert equal and opposite forces upon each of such bell crank linkages to produce a balanced force upon the ring gear. Rotation of the ring gear cuases simultaneous adjustment of a plurality of movable nozzle vanes.

The primary object of the present invention is to produce an inexpensive and efficiently operative actuator system for movable nozzles of a gas turbine engine.

Another object of the present invention is to provide an actuator system for gas turbine engine nozzles which utilizes a ring gear and a single double-acting hydraulic jack for applying balanced forces to said ring gear.

A further object of the present invention is to provide such a nozzle actuating mechanism which includes shielded internally disposed bell crank linkages.

Other objects and advantages of the present invention will become apparent from the following drawings and descriptions.

DETAILED DESCRIPTION

Figures 1, 3:
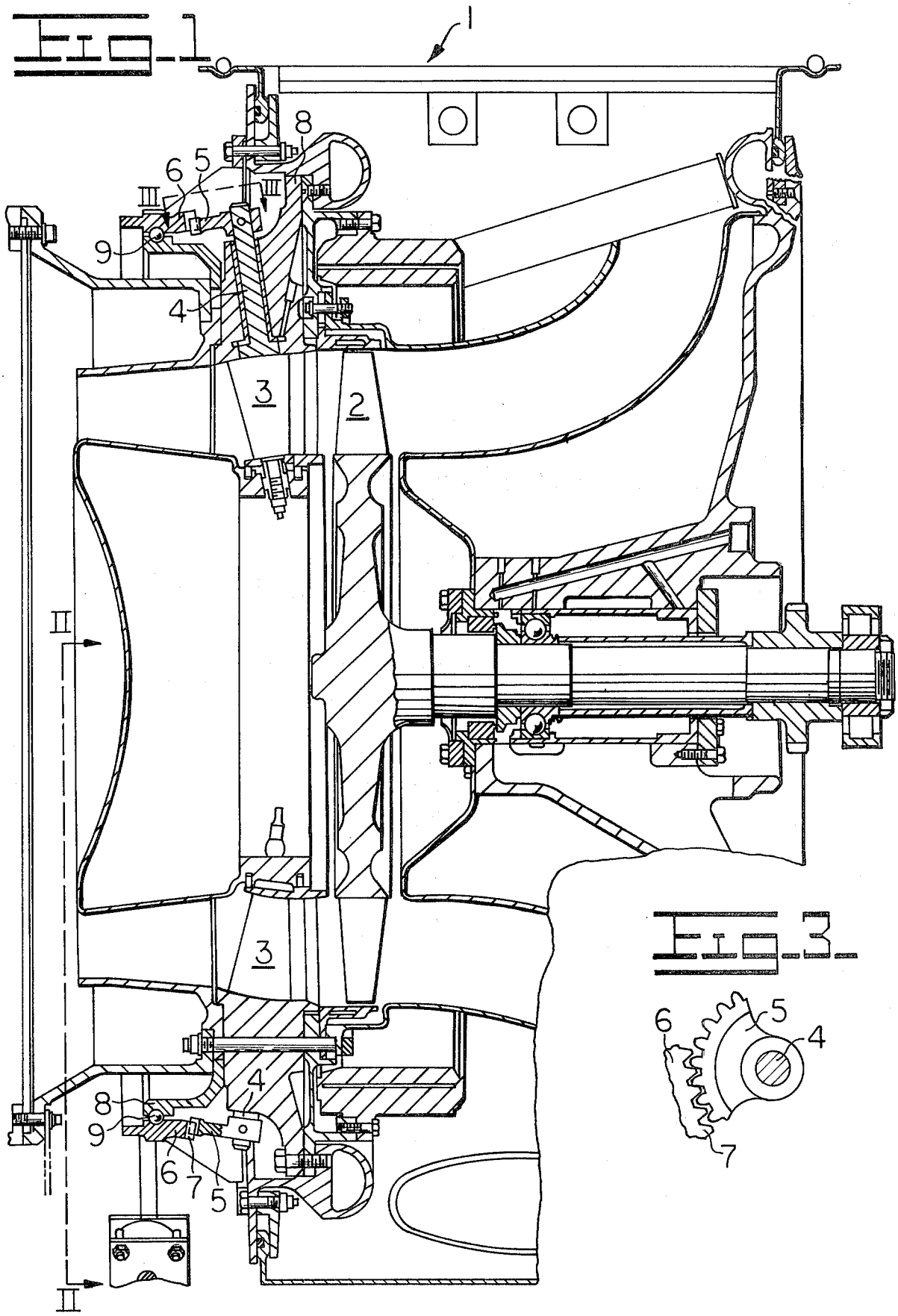
FIG. 1 is a sectional elevation of a portion of a gas turbine engine equipped with the instant means for varying the position of a nozzle vane.
FIG. 3 is a partial section taken along the line III—III of FIG. 1.
Figure 2:
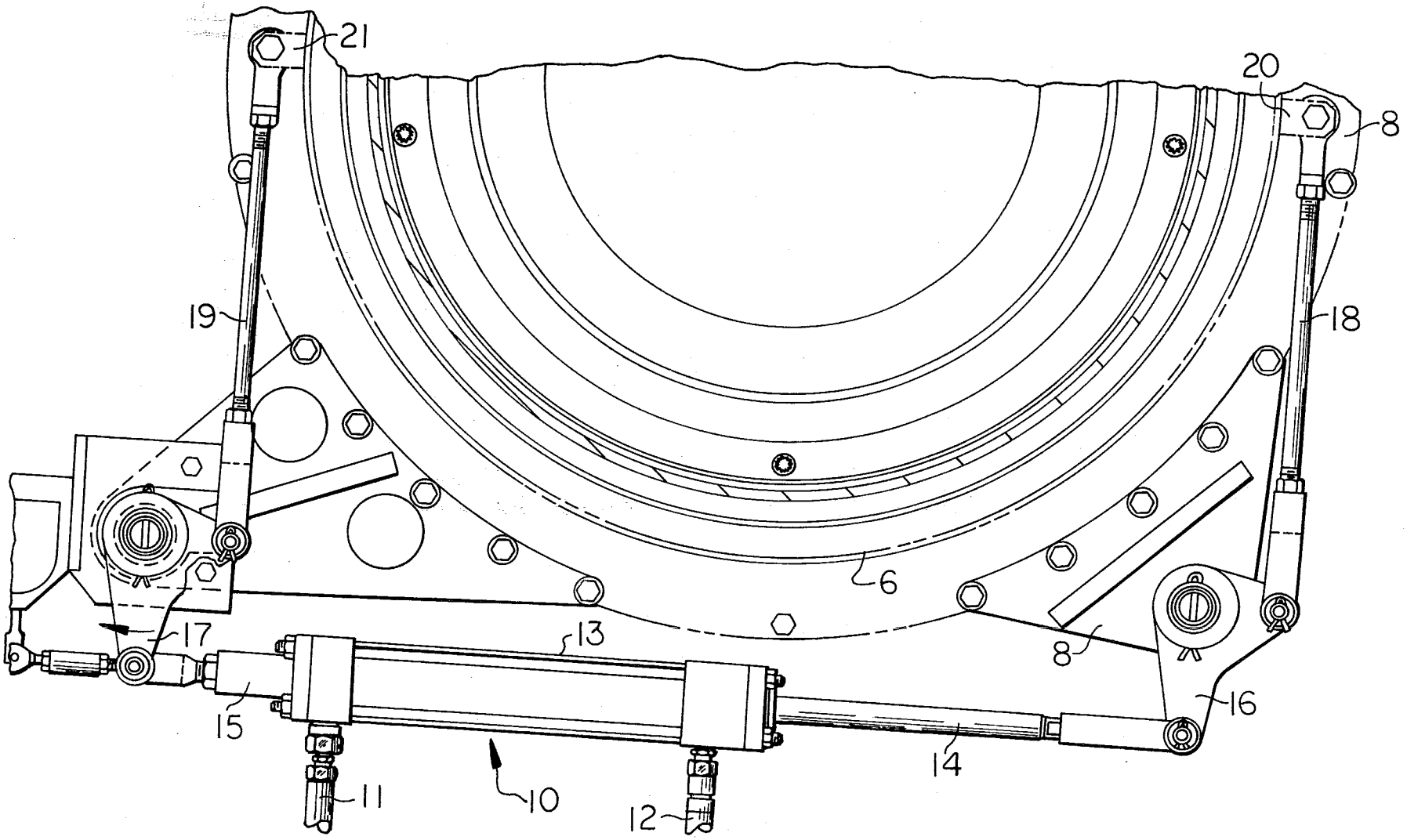
FIG. 2 is a partial sectional view taken along the line II—II of FIG. 1.

With particular reference to FIGS. 1, 2, and 3 of the drawings, the preferred embodiment of the instant invention will now be presented. A portion of a gas turbine engine is shown generally at 1. It includes conventional rotor means 2 and variable area nozzle vanes 3. The nozzle vanes are each rotatably mounted upon shafts 4 journaled within suitable bearings within a turbine housing 8. Each of the vane shafts 4 is equipped with a gear segment 5 keyed thereto such that when the gear segment is angularly displaced, the shaft 4 and vane 3 will move proportionally. The engine is also equipped with a ring gear 6 provided with a plurality of teeth 7 adapted to engage the teeth on the gear segment 5. The ring gear 6 is suitably mounted for rotation upon a plurality of bearings 9 on another portion of the engine housing 8. Rotation of the ring gear 6 causes simultaneous actuation of each of the gear segments 5 and consequent simultaneous adjustment of each of the nozzle vanes 3.

By reference to FIG. 2 in the drawings, the inventive actuating means for rotating the ring gear 6 may be readily appreciated. A single double-acting fluid motor, such as a hydraulic jack is shown at 10. The jack is of conventional construction and is equipped with conduits 11 and 12 for supplying and exhausting fluid under pressure to and from opposite ends of a chamber 13. The jack has a rod 14 and connector 15 which, when rod 14 is extended or retracted, causes rotation of a pair of bell cranks 16, 17. Such bell cranks are in turn connected to a pair of links 18, 19 which are pivotally connected to a pair of bosses 20, 21 disposed in diametrical opposition upon the periphery of the ring gear 6. Upon actuation of the free-floating jack 10, equal and opposite forces are exerted, through the elements 14 and 15, upon the bell cranks 16 and 17 to exert balanced forces on the bosses 20, 21 to cause the ring gear 6 to rotate with consequent adjustment of the nozzle vanes 3.

Figure 4:
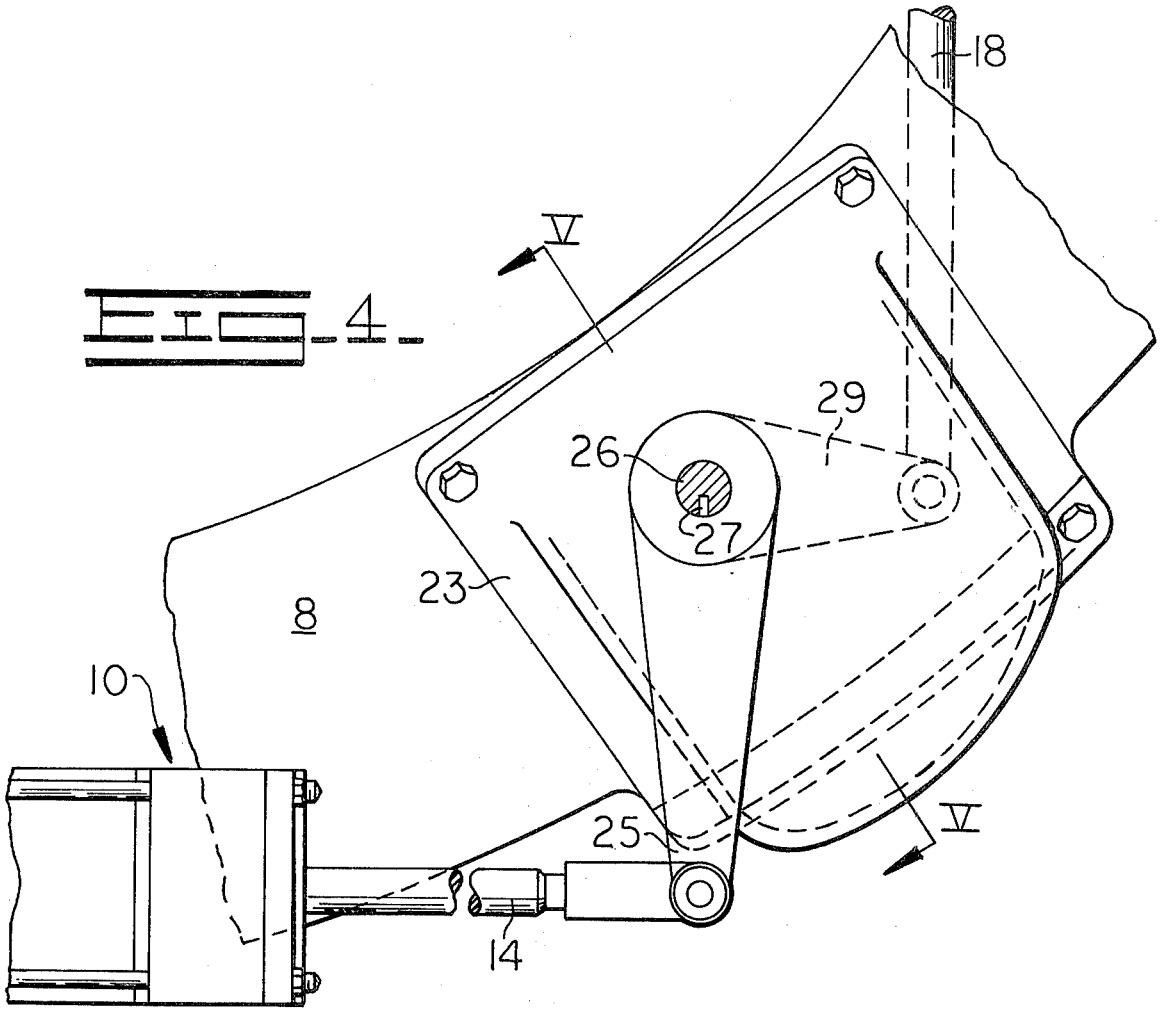
FIG. 4 is a view of an alternate embodiment of the instant linkage means showing the bell crank mechanism mounted internally of a protective housing.
Figure 5:
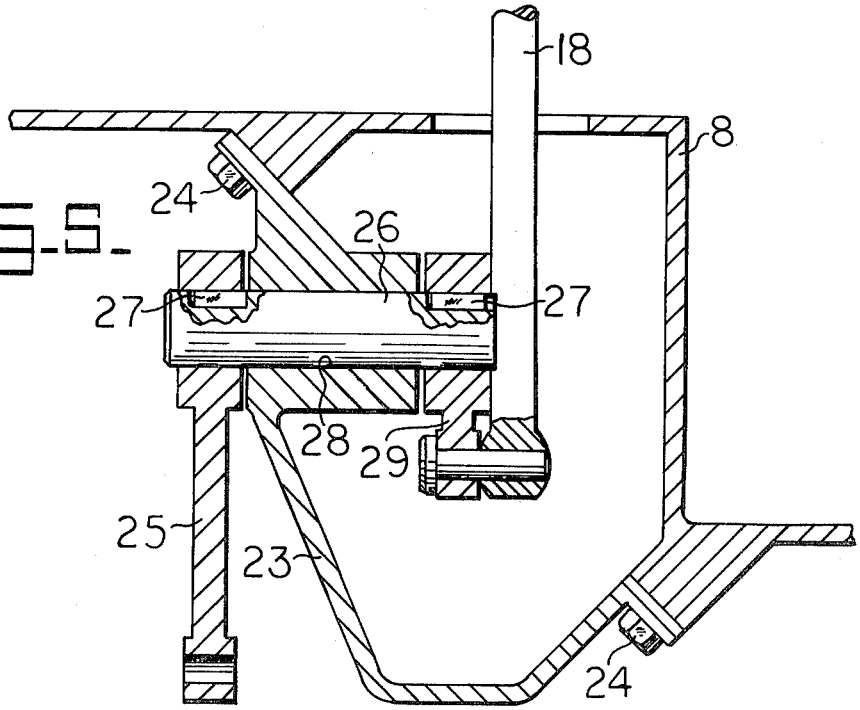
FIG. 5 is a sectional view taken along the line V—V of FIG. 4.

In FIGS. 4 and 5, an alternate embodiment of the particular linkage between the jack 10 and the links 18, 19 may be appreciated. In this embodiment, a housing 23 is attached, by bolts 24 or the like, to a portion of the engine housing 8. Instead of the one-piece bell cranks 16, 17 shown in the primary embodiment, an externally disposed lever 25 is provided and is fixed to a shaft 26 by suitable means such as splines or keys 27 and received within a bore 28 of the housing 23. At an opposite end of the shaft 26 is keyed a second lever arm 29 to which is pivotally connected one of the links 18 which connects with the diametrically opposed bosses 20, 21. The operation of this embodiment is the same as that of the primary embodiment, the only difference being the protective housing or the linkage means.

In view of the foregoing, it will be apparent that the present invention provides a vastly improved and efficient nozzle vane adjusting means. A single double-acting hydraulic jack drives the vane positioning ring gear at two points spaced 180° apart on the periphery of the ring gear to effectively eliminate side loading on the ring gear by providing precisely balanced actuating forces. By adjusting the bell crank ratios, the instant invention can provide variable mechanical advantages to provide versatility in selecting jack cylinder diameter sizes and pressures required to actuate the mechanism. Because the forces on the ring gear are balanced, the nozzle vanes remain accurately positioned until such time as an actuating force is applied to read just such position.

While the invention has been described with particular reference to the preferred embodiments, it is apparent that variations and modifications are possible within the spirit of the inventive concepts. No limitations with respect to such variations and modifications is intended except as engrossed by the scope of the appended claims.

We claim:

1. A movable vane assembly of the type used in a gas turbine engine or compressor for interaction with a gas stream comprising: a plurality of radially aligned vanes circumferentially arranged within an annular passage formed by a first housing, said vanes being supported for rotation about their radial axes to vary the effective cross sectional area of said annular passage, a plurality of rotatable gear means connected for rotation with said plurality of aligned vanes, a ring gear having teeth means adapted for simultaneous engagement with the teeth means of said plurality of rotatable gear means such that rotation of the ring gear causes rotation of said plurality of vanes, actuating means for selectively rotating said ring gear, said actuation means including first and second link means connected at first and second diametrically opposed points on the periphery of said ring gear, and first motor means for simultaneously actuating said first and second links to rotate said ring gear, said actuating means further including first and second bell crank means connected between said first and second links and said first motor means, first lever means connected by rod means for movement with said fluid motor, said first lever means being fixed for rotation upon a first shaft, and second lever means also fixed for rotation upon said first shaft and connected for movement with said link means.

2. The invention of claim 1 wherein said first shaft is mounted within bore means in a second housing and wherein said first lever means is external of said second housing and said second lever means is internally disposed within said second housing.

3. The invention of claim 2 wherein said plurality of rotatable gear means include a plurality of gear segments each mounted upon a separate second shaft, each said separate second shaft also supportively mounting one of said plurality of radially aligned vanes.

4. The invention of claim 3 wherein said second housing is removably secured to said first housing by a plurality of movable threaded bolts.

5. The invention of claim 1 wherein said first lever means and said second lever means are fixed upon opposite end portions of said first shaft by key means.

* * * * *

UNITED STATES PATENT OFFICE

CERTIFICATE OF CORRECTION

Patent No. 4,003,675 Dated January 18, 1977

Inventor(s) WALLACE G. STEVENS et al.

It is certified that error appears in the above-identified patent and that said Letters Patent are hereby corrected as shown below:

Col. 4, line 6, "said actuation" should read

--'said actuating --.

Col. 4, line 13, "motor means," should read

-- motor means and each comprising --.

Signed and Sealed this

Thirtieth Day of May 1978

[SEAL]

Attest:

RUTH C. MASON
Attesting Officer

LUTRELLE F. PARKER
Acting Commissioner of Patents and Trademarks